United States Patent [19]

Shimizu

[11] Patent Number: 4,523,614

[45] Date of Patent: Jun. 18, 1985

[54] APPARATUS FOR DETECTION OF END BREAKAGE IN HEDDLE FRAME

[75] Inventor: Yoichi Shimizu, Izumishi, Japan

[73] Assignee: Kabushiki Kaisha Maruyama Seisakucho, Sakaishi, Japan

[21] Appl. No.: 541,040

[22] Filed: Oct. 12, 1983

[51] Int. Cl.[3] ..... D03D 51/32

[52] U.S. Cl. ..... 139/355

[58] Field of Search ..... 139/337, 353, 355, 356, 139/358

[56] References Cited

FOREIGN PATENT DOCUMENTS

| | | | |
|---|---|---|---|
| 2385 | 1/1904 | France | 139/355 |
| 683157 | 2/1930 | France | 139/355 |
| 696192 | 10/1965 | Italy | 139/337 |

*Primary Examiner*—Henry S. Jaudon

*Attorney, Agent, or Firm*—Oblon, Fisher, Spivak, McClelland & Maier

[57] ABSTRACT

A vertically reciprocatible heddle frame has side beams including a heddle bar fixed to the side beams, and heddles loosely mounted on the heddle bar with vertical play. A device for detecting end breakage of yarn supported by the heddles consists of an electrically conductive bar mounted on a resilient holding element. The resilient holding element leaves access at the top for contact between the heddles and the detecting bar. An electrical current flows through the detecting bar only during the downward movement of the heddle frame. End breakage of yarn permits a heddle to contact the detecting bar during such downward motion, and the resulting completed electrical circuit can be detected by appropriate detecting means.

6 Claims, 4 Drawing Figures

APPARATUS FOR DETECTION OF END BREAKAGE IN HEDDLE FRAME

BACKGROUND OF THE INVENTION

1. Field of the Invention

The present invention relates to the detection of end breakage in a heddle frame.

2. Description of the Prior Art

In the past, a dropper has been used to detect end breakage in a heddle frame. However, weak points began to appear with the speeding up of shedding motion of the heddle frame, so that the dropper became inadequate.

SUMMARY OF THE INVENTION

The present inventor noticed a relation between the heddle bar and heddle in that the heddle contacts the upper surface of the heddle bar during upward movement, and during downward movement the heddle does not contact the upper surface of the heddle bar because of the tension of the yarn. Therefore the heddle will contact the heddle bar during downward movement only when the yarn is cut, and end breakage can be detected by detecting this contact of the heddle with the heddle bar during downward movement.

The instant invention has as an object the provision of an apparatus for detection of end breakage in a heddle frame which will simply and surely detect the end breakage by employing the characteristics of the shedding motion.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
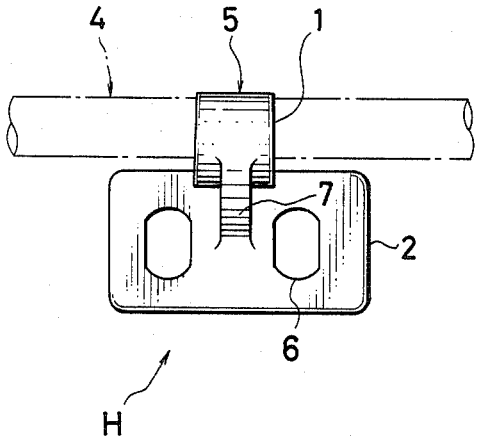
FIG. 1 is a front elevation of the detection bar holder used in a preferred embodiment of the apparatus for detection of end breakage in a heddle frame.
Figure 2:
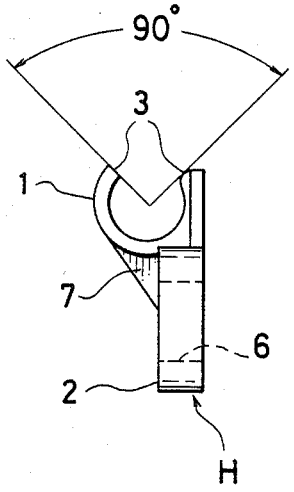
FIG. 2 is a right side view of the apparatus of FIG. 1.

In FIGS. 1 and 2, 1 is a holding part, 2 is a holder body. The holding part 1 and holder body 2 are formed of resilient plastic as one body, and constitute the holder H of the invention. Numeral 3 is an opening formed by cutting off the upper end part 5 of the holding part 1. The holding part 1 has a semi-annular shape, with the opening 3 defining a 90° cut out having a center passing through the center of the semi-annular shape. The width of the opening is smaller than the diameter of the detecting bar 4, which is held in the holding part 1, so that when the detection bar 4 is inserted into the opening 3 of the holding part 1, the opening 3 of the holding part 1 will resiliently expand. The detection bar 4 is resiliently held by the semi-annular shaped holding part 1 and can be taken out from the holding part 1 when the detection bar 4 is pulled up. Numeral 6 indicates elongated holes for screw clamping formed in the holder body 2 to the right and left of the rib 7, the rib 7 connecting the holding part 1 and the holder 2. The elongated holes are made longer in the direction perpendicular to the longitudinal direction of the detection bar 4 being held in the holding part 1, i.e. the longitudinal direction of the heddle.

Figure 3:
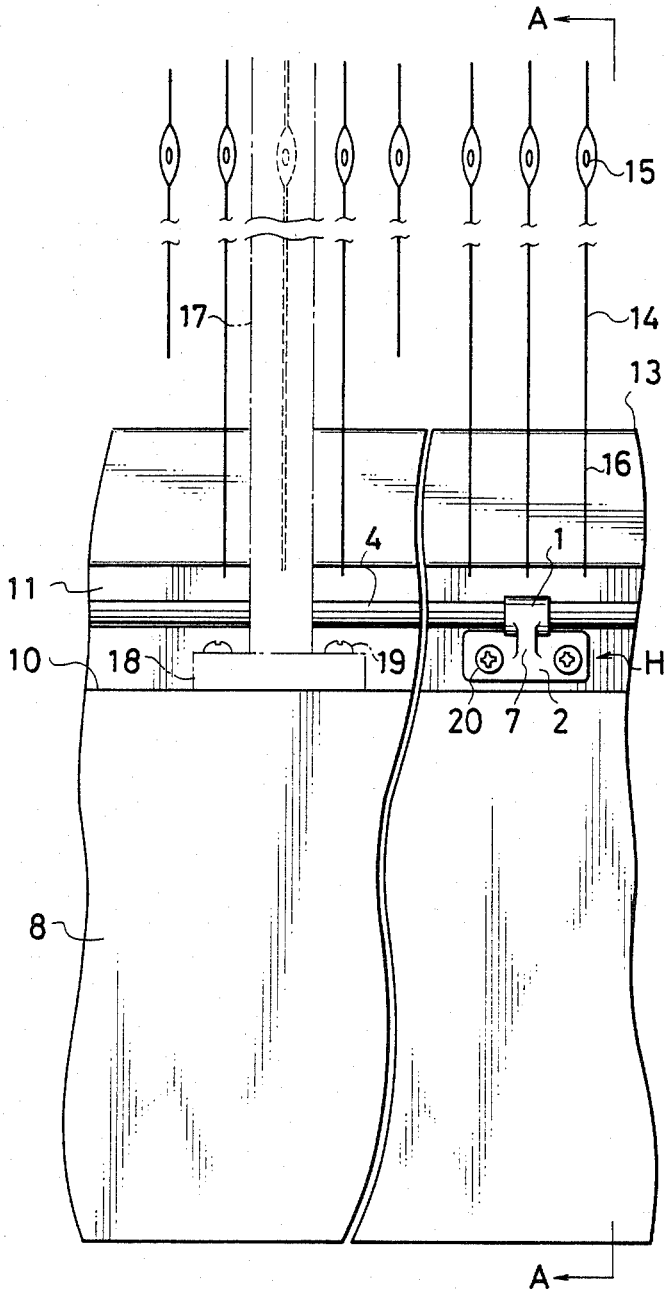
FIG. 3 is a partial front view showing the attachment of the detection bar to the heddle frame using the holder of the present invention.
Figure 4:
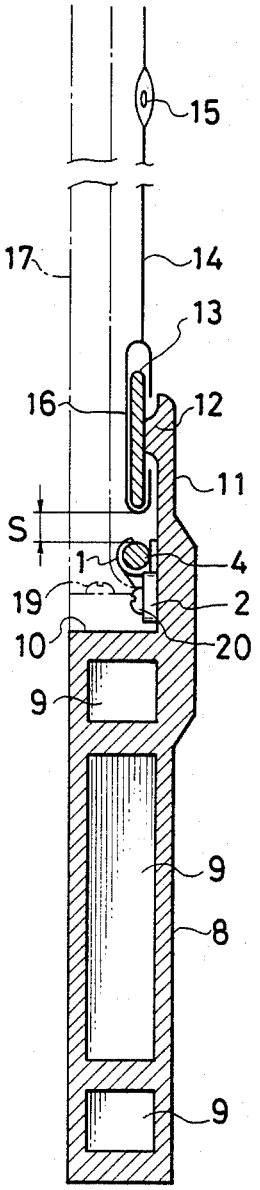
FIG. 4 is a sectional view through line A—A of FIG. 3.

In FIGS. 3 and 4, 8 denotes a lower stage side beam horizontally suspended to a side stay of the heddle frame, and formed of drawn aluminum material. The lower stage side beam 8 is of hollow construction 9 to reduce the weight of the heddle frame. Numeral 10 denotes an inner end face of side beam 8, and to one end of the inner end face 10 (right side in FIG. 4) a side wall 11 is attached and extends perpendicular to the direction of inner end face 10 of the horizontal beam 8. Numeral 12 denotes an extruded part formed on the side wall 11 along the longitudinal direction of the side beam 8, and a band shaped heddle bar 13 is fixedly attached to its end face. Numeral 14 is a heddle having warp hole 15 in the center part, and having C-shaped engaging parts 16 at both ends. The engaging part 16 is loosely fitted to the heddle bar 13 as shown in FIG. 4, and engaged so that it freely slides along the heddle bar 13. Numeral 17 denotes a center stay attached to the center of the longitudinal length of the side beam 8. The center stay is attached to the inner end face 10 of the side beam 8 by means of set screws 19 which are screwed in T-shaped leg portions 18 at both ends of the center stay.

The holder H of this invention is fixed to the side beam 8 by attaching the holder body 2 to the side wall 11 of the side beam 8 by use of the set screws 20 screwed through the elongated holes 6.

Numeral 4 denotes the detecting bar which is held in the holding part 1 of the holder H fixed to the side wall 11 of the side beam 8. The detecting bar 4 is placed directly under the engaging part 16 of each heddle 14 which is engaged to the heddle bar 13, so that the detection bar 4 is held parallel to the heddle bar 13 with a certain spacing S when each heddle 14 is normally operated by moving downward with a warp passing through the warp hole 15, and the lower end of the engaging part 16 of each of the heddles 14 does not touch the detecting bar 4.

Therefore, when a warp of the heddle 14 which is positioned above the holding part 1 of the holder H causes end breakage during downward movement, tension of the yarn, which had been acting to raise the heddle 14, will be lost and the heddle 14 will be lowered by its own weight by the distance of vertical direction looseness of the engagement of engaging part 16 of the heddle 14 with the heddle bar 13. Then the lower end of the engaging part 16 of the heddle 14 is seated on the upper surface of the detecting bar 4 which is exposed at the opening 3 of the holding part 1 of the holder H. Therefore end breakage can be detected by flowing an electric current through detecting bar 4 only during downward motion. The heddle constitutes a ground for the circuit. End breakage of other heddles 14 can likewise be detected electrically during the operation of the heddle frame, through the detecting bar 4. That is, contact between a heddle and the detection bar closes an electric circuit, which is easily detected by a detector (not shown).

When attaching the detection bar 4 to the heddle frame, elongated holes 6 formed in the holder body 2 allow vertical adjustment of the detecting bar 4 in view of the gap S between the bar 4 and the lower end of the engaging part 16 of the heddle 14. Therefore the detection bar 4 can be attached at the optimal position regardless of the dimensional and assembling discrepancies of the heddle frame. Further, the holder H is made of plastic material, allowing the insertion and removal of the detecting bar 4 through the opening 3; therefore the replacement of the detection bar is quite easy, and can be performed in a short time.

Although elongated holes for screw clamping are formed in the preferred embodiment, they are necessary only for the adjustment of the attaching position, and round holes may be used when adjustment is not necessary.

Further, in this embodiment the interior of the holding part 1 of the holder H is made in semi-annular form. However, the design may be changed so as to correspond to the sectional configuration and dimensions of the detection bar 4.

Also, the detection bar 4 is to be positioned in the holding part 1 of the holder H such that it does not touch the center stay 17.

As has been explained above in detail, the invention positions the detection bar at the under side of the heddle bar to be parallel to it, and the heddles seat on the detection bar when end breakage occurs. Therefore end breakage can be detected by passing electric current through the detecting bar during downward movement.

Further, because the holder is formed of plastic, and an opening is formed in the upper end of the holding part so that the upper surface of the detecting bar being held in the holder part is exposed, the instant invention has many advantages as the end breakage at the heddle can be detected as can the end breakage of another heddle, allowing immediate replacement of a detection bar. The structure is simple, can be manufactured at low cost and has far superior functioning as compared to a conventional apparatus. Therefore, this invention provides an end breakage detection bar holder of a heddle which is quite convenient for practical application.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. For use in a vertically reciprocable heddle frame having a heddle bar and at least one heddle, the heddle having a yarn warp hole and an electrically conductive engaging part loosely mounted on the heddle bar with a vertical play, a device for detecting breakage of yarn passing through the yarn warp hole in the heddle, said device comprising:

(a) an electrically conductive detecting element extending parallel to the heddle bar, said electrically conductive detecting element being positioned immediately below the electrically conductive engaging part of the heddle by a distance not greater than the vertical play of the electrically conductive engaging part of the heddle;

(b) a non-electrically conductive holder for supporting said electrically conductive detecting element in position to contact the electrically conductive engaging part of the heddle when the yarn passing through the yarn warp hole in the heddle breaks, said holder comprising:

(i) a resilient holding element having a through hole size, shaped, and positioned to receive and position said electrically conductive detecting element and a top opening sized and shaped so that said electrically conductive detecting element can pass therethrough when the top opening is opened against the resiliency of said resilient holding element, said top opening also being sized, shaped, and positioned so that the electrically conductive engaging part of the heddle can contact said electrically conductive detecting element through said opening while said electrically conductive detecting element is received in said through hole and (ii) a holder body secured to said resilient holding element; and (c) means for securing said non-electrically conductive holder on the heddle frame, whereby, if an electric current is applied to said electrically conductive detecting element during downward movement of the heddle frame, the breakage of yarn passing through the yarn warp hole in the heddle can be detected because the breakage of the yarn permits the heddle to drop until the electrically conductive engaging part of the heddle makes contact with said electrically conductive detecting element, completing an alarm circuit.

2. A device as recited in claim 1 wherein said electrically conductive detecting element is bar shaped.

3. A device as recited in claim 1 wherein said electrically conductive detecting element is round in cross-section.

4. A device as recited in claim 1 wherein said resilient holding element and said holder body are formed integrally.

5. A device as recited in claim 1 wherein said means for securing said non-electrically conductive holder on the heddle frame comprises:

(a) at least one vertically elongated hole in said holder body and (b) a securement element extending through said at least one vertically elongated hole.

6. A device as recited in claim 1 wherein the heddle frame further comprises a side beam, the heddle bar is fixed to the side beam, and said means for securing said non-electrically conductive holder on the heddle frame is arranged to secure said holder body to the side beam.

* * * * *